US008869989B2

(12) United States Patent
Gallagher

(10) Patent No.: US 8,869,989 B2
(45) Date of Patent: Oct. 28, 2014

(54) PULP SCREEN ROTOR WITH SLURRY PASSAGES AROUND AND THROUGH THE ROTOR

(71) Applicant: Brian James Gallagher, Litchfield, NH (US)

(72) Inventor: Brian James Gallagher, Litchfield, NH (US)

(73) Assignee: Ovivo Luxembourg S.à.r.l., Luxembourg (LU)

( * ) Notice: Subject to any disclaimer, the term of this patent is extended or adjusted under 35 U.S.C. 154(b) by 0 days.

(21) Appl. No.: 13/712,868

(22) Filed: Dec. 12, 2012

(65) Prior Publication Data

US 2014/0158586 A1 Jun. 12, 2014

(51) Int. Cl.
*B07B 1/06* (2006.01)
*B07B 1/18* (2006.01)

(52) U.S. Cl.
CPC ..... *B07B 1/18* (2013.01)
USPC ..... 209/283; 210/415; 162/55

(58) Field of Classification Search
USPC ..... 209/273, 413, 415, 270, 281, 283; 210/414, 415; 162/55
See application file for complete search history.

(56) References Cited

U.S. PATENT DOCUMENTS 4,832,832 A * 5/1989 Fujiwara et al. ..... 209/273
5,307,939 A * 5/1994 Young et al. ..... 209/270
5,497,886 A * 3/1996 Young et al. ..... 209/270

* cited by examiner

*Primary Examiner* — Joseph C Rodriguez
*Assistant Examiner* — Kalyanavenkateshware Kumar
(74) *Attorney, Agent, or Firm* — James Earl Lowe, Jr.

(57) ABSTRACT

A rotor adapted for mounting for rotation within a screen of a pulp screening apparatus, and for defining a screening space between the rotor and the screen so that pulp suspension flows into the screening space, with accepted pulp passing through the screen to a stock outlet and rejected pulp passing along a screen inlet surface in a screening flow direction to a rejects outlet. The rotor has an interior, and an exterior with pressure impulse protuberances thereon for rotation with the rotor in close proximity to the inlet surface. A stock inlet communicates with the screening space and the rotor interior. And the rotor has at least one opening extending in the screening flow direction from its interior to its exterior for over at least a fourth of screening flow length of the rotor for admitting a substantial portion of pulp suspension from the stock inlet and the rotor interior into the screening space.

18 Claims, 6 Drawing Sheets

PULP SCREEN ROTOR WITH SLURRY PASSAGES AROUND AND THROUGH THE ROTOR

BACKGROUND

This invention relates to rotors and pressure screens and, more particularly, to a rotor for a screen for removing contaminants from a suspension of paper making pulp.

In the manufacture and treatment of papermaking pulp, pressure screens are used to separate and remove undesirable contaminants from the process. These contaminants may take the form of foreign materials introduced into the process with the raw material, or they may be remnants of the pulp production process itself, such as fiber bundles (also called "shives") left over from the production of chemical pulp, or undefibered flakes that were not reduced to good fiber in a pulper.

Separation of this undesirable material is referred to as screening, and requires passing the pulp slurry through very small openings; most typically slotted screen cylinders are used with slot openings of between 0.10 and 0.40 mm.

Screens work with pulp in slurry form at an oven-dry consistency of about 4-5% or less, most commonly in the range of 2-3%. These machines have a continuous liquid reject stream that must be further treated to recover good fiber; therefore, multi-stage cascaded systems are usually installed.

Closed pressure screens in which a flat or cylindrical screen is used to separate a suspension of paper-making pulp into an accepts pulp fraction and a reject fraction have long been used for paper pulp cleaning. Such pressure screens commonly employ a generally cylindrical foraminous screening member, which may have an aperture pattern made up of either holes or slots. A rotating impulse member is positioned to operate adjacent a surface of the screen, which is commonly, but not always, an inner inlet surface, to maintain the stock suspension in a state of agitation and to provide pressure impulses to aid the screening function. The rotating-member may comprise a drum-type rotor in which protuberances or foil-shaped sections are mounted on the outer surface and move adjacent to a screen surface, or foils may be mounted on generally radially extending arms for rotation adjacent the screen surface.

Commonly, the pulp stock suspension to be screened is brought in at or adjacent an axial end of a cylindrical screen and, during screening, moves axially between the inlet surface, as stated above, commonly the inner surface of the screen cylinder, and the surface of the aforesaid drum-type rotor. At the same time, a rejects fraction is created by the inhibition or screening out of undesirable material which does not pass through the apertures or openings in the screen cylinder, and this undesirable material also moves axially along the screen surface until it reaches the end of the screen axially opposite the inlet end, where it is directed to a rejects accumulation chamber and then to a rejects outlet.

Conventionally, the stock suspension enters at one end of the screen, or enters at the center of the screen and flows in opposite directions over the screen. The multiple foils perform the well-known impulse and screening function such that the fibers are accepted through the perforated or slotted screen while the larger or longer material that is unable to go through such perforations is retained within the screening zone until it reaches the rejects outlet.

It is also known that a pressure screen can be a single screen or a plurality of separate screens, divided into a plurality of axially spaced screening bands or zones, with means provided for applying the stock suspension under pressure directly to the inlet side of the screening surface, at each zone. Such axially disposed zones individually form a portion of the total axial extent of the screening means. At least one rejects receiving or collection area is provided for each such zone.

In current screens, some important features are that the separation barrier (screen cylinder) has very small openings, usually slots of 0.15 to 0.30 m in width. As the flow travels toward the other end (in this example, the bottom), good fibers in the liquid slurry pass outward through the screen plate openings, while contaminants (especially shives) continue until they pass out of the reject end of the screening zone.

As screens become larger, the area of the screening surface increases roughly with the square of the diameter (assuming the proportions of diameter to height are held constant). The entry area into the screening space, which is the annulus between the drum-style rotor and the screen cylinder, however, only increases roughly linearly with diameter. This means that as the screen gets larger, the entry velocity increases if the same flow per unit of screen plate area is to be maintained.

At some point, this increased velocity will cause one or both of an unacceptably high pressure drop, or performance degradation of the machine, because the desired flow velocity relationship between the pulse-generating elements on the rotor and the fluid is destroyed.

The problem thus to be overcome is that the entry velocity into the annular space between the drum-style rotor and the screen cylinder gets extremely high as screens become larger (the screen plate area goes up as the square of diameter, but the opening area goes up linearly).

At least two conventional offerings have sought to overcome this problem, using fundamentally the same approach. They reduce the height of the screen cylinder relative to the diameter, which increases the ratio of the inlet area to the screening area.

This approach has significant disadvantages. It either makes the rotor very complicated to manufacture (see FIG. 4) or it makes the machine very expensive to build (see FIG. 5).

The FIG. 4 design 10 uses the concept of stacking two short screens one on top of the other, with the inlet-to-reject flow direction being the same in both. Each part is only half the height of the cylinder; therefore the total entry area into the annular chamber effectively becomes twice the size.

This is executed by having a normal entry at the top. Just above the halfway point down the screen cylinder surface, scoops 11 on the rotor facing in the forward direction draw the flow inward into a channel inside the design, and from there it goes down to the bottom and out the rejects outlet.

At the top of the rotor 10 there is also an annular chamber open at the top slightly closer to the centerline than the normal entry. Some pulp (ideally one-half) passes downward in this chamber. It exits the rotor radially outward through a circumferential slot 12 located just below the halfway point, and just below the scoops 11 that picked up the flow from the top half. The second part of the flow now travels downward as it would in a conventional screen and out into the reject outlet at the bottom.

The FIG. 5 design 15 combines two screens, one on top of the other, but does it as if they were totally separate screens. The inlet is in the middle, with separate rejects at the top and bottom. In this case, the inlet-to-reject flow directions are opposite to each other.

One disadvantage to this approach is cost. Many more components and connections are required than would be necessary if it were a single, uncomplicated design. Another is that it is more complicated to disassemble for maintenance than a more conventional construction would be.

SUMMARY

Disclosed is a drum-type rotor adapted for mounting for rotation within a screen of a pulp screening apparatus, and for defining a screening space between the rotor and the screen so that pulp suspension flows into the screening space, with accepted pulp passing through the screen to a stock outlet and rejected pulp passing along a screen inlet surface in a screening flow direction to a rejects outlet. The rotor has an interior, and an exterior with pressure impulse protuberances thereon for rotation with the rotor in close proximity to the inlet surface of the screen cylinder. A stock inlet communicates with the screening space between the screen cylinder inlet surface and the rotor interior. The rotor has at least one opening extending in the screening flow direction from its interior to its exterior for over at least a fourth of screening flow length of the rotor for admitting a substantial portion of pulp suspension from the stock inlet and the rotor interior into the screening space.

In the screen rotor of this disclosure, the open top of the rotor communicates via the slot in the rotor surface to admit more stock down the length of the rotor, so that it doesn't have to all come in the usual annular inlet. Everything at all times moves downward (in a top-fed vertical screen; it would go horizontally in a horizontal screen or upward in a bottom-fed screen). The relative opening sizes are such that a big part of the flow still comes in the annular inlet as it always did; but the remainder of the flow comes out through the drum surface to join the downward flow over the length of it.

Figure 1:
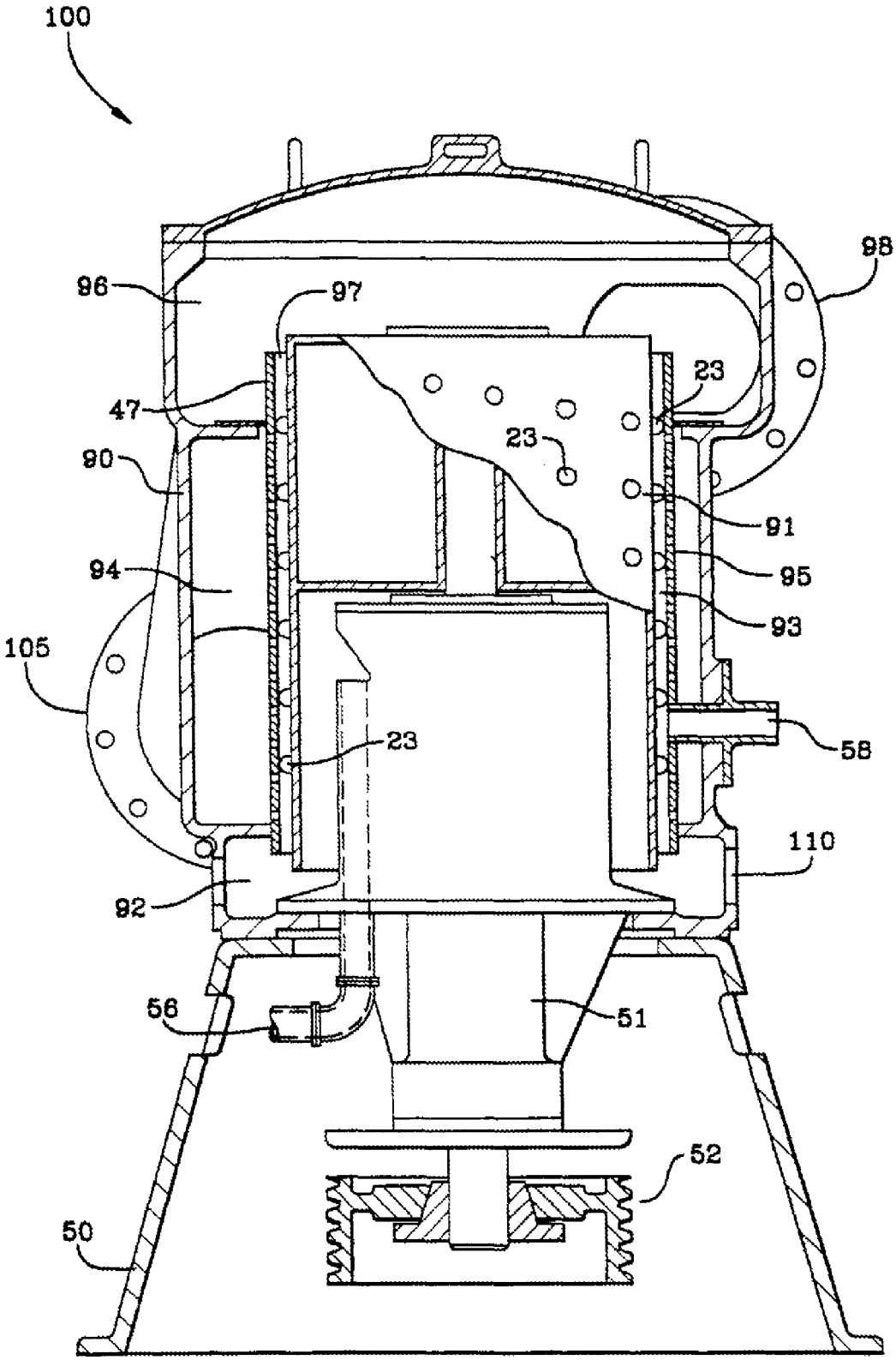
FIG. 1 PRIOR ART
FIG. 1 is a cross-sectional partially fragmentary schematic side view illustrating a generalized embodiment of a pulp fine-screening device and the overall structure of a typical such machine.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DESCRIPTION OF THE PREFERRED EMBODIMENT

Referring to FIG. 1, common features of pulp fine-screening equipment can be seen. A screening apparatus 100 is made up of a base 50 upon which housing 90 is mounted. (The apparatus shown here is vertically oriented, but it is known that screening apparatus may be in any orientation between horizontal and vertical, with the inlet-to-reject flow in any direction, and said orientation has no effect on the performance of the apparatus.) Housing 90 has an end mounted inlet chamber 96 with a pulp inlet 98 through which pulp is tangentially fed for screening. The pulp flows around and over inlet wall 47 into pulp entrance 97 that is defined by the annular space or annulus between the portion of rotor 91 projecting above the perforated portion of screen 95 and inlet wall 47. Rotor 91 has a closed top, a generally cylindrical surface, and, on the portion of the rotor adjacent to the perforated portion of screen 95, in most cases, one or more projections 23 or other surface irregularities for generating negative pressure pulsations. These are intended to help prevent blocking the screen by causing momentary flow reversals through the perforations of the screen 95. The annular space between rotor 91 and screen 95 defines a screening chamber 93, while the space outboard of the screen 95 contains accepts chamber 94 which is drained by accepts discharge 105. Below accepts chamber 94 and screening chamber 93 is rejects chamber 92 which empties through rejects outlet or discharge 110. Rotor 91 is rotated by a shaft that extends through a sealed center column 51, and that is driven by a prime mover (not shown) through drive pulley 52. Dilution inlets 56 and 58 are also shown.

Figure 2:
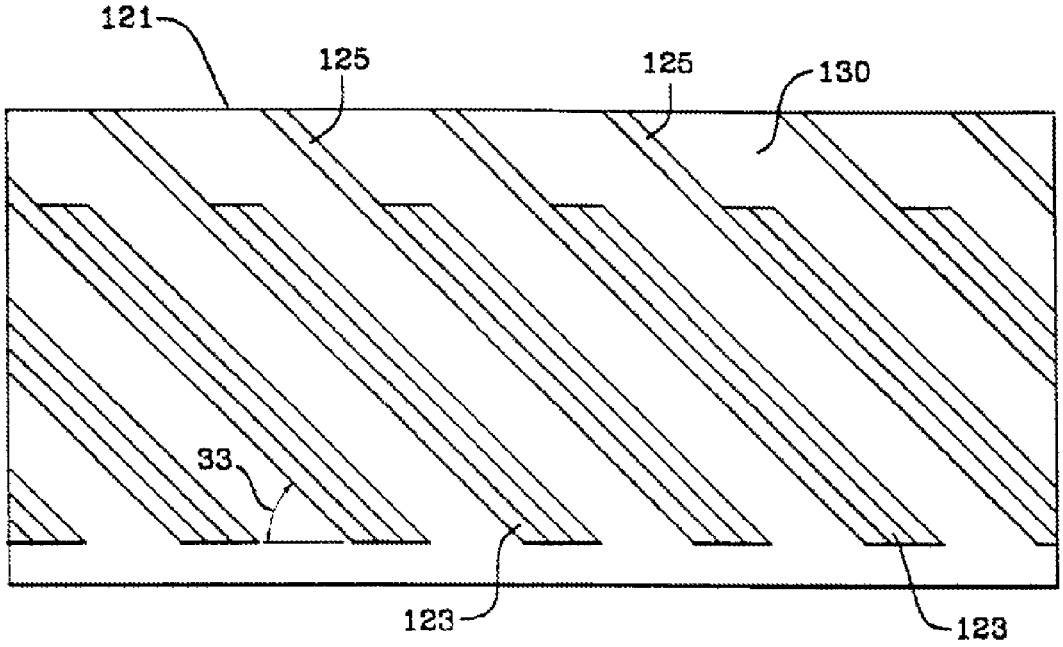
FIG. 2 PRIOR ART
FIG. 2 is a schematic elevation view of a rotor incorporating surface protuberances or projections as it would appear if the surface were detached from the rotor support frame and unrolled to flatten.
Figure 3:
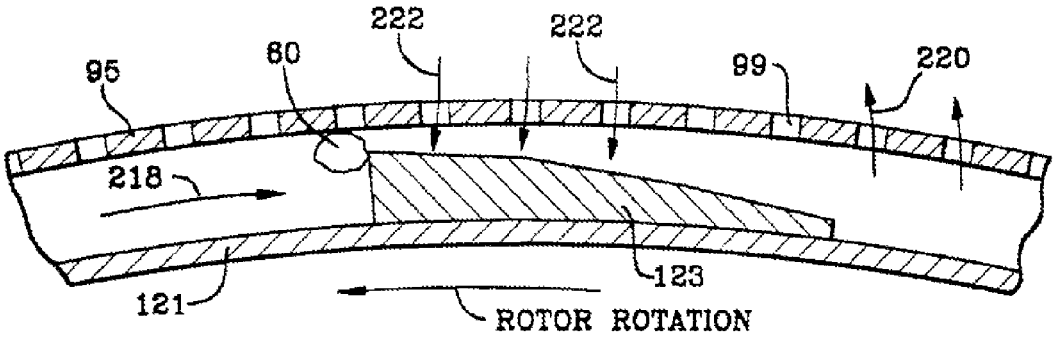
FIG. 3 PRIOR ART
FIG. 3 is a fragmentary plan view of the rotor of FIG. 2 in the "rolled" condition illustrating the relationship between the rotor surface and the screen.
Figure 5:
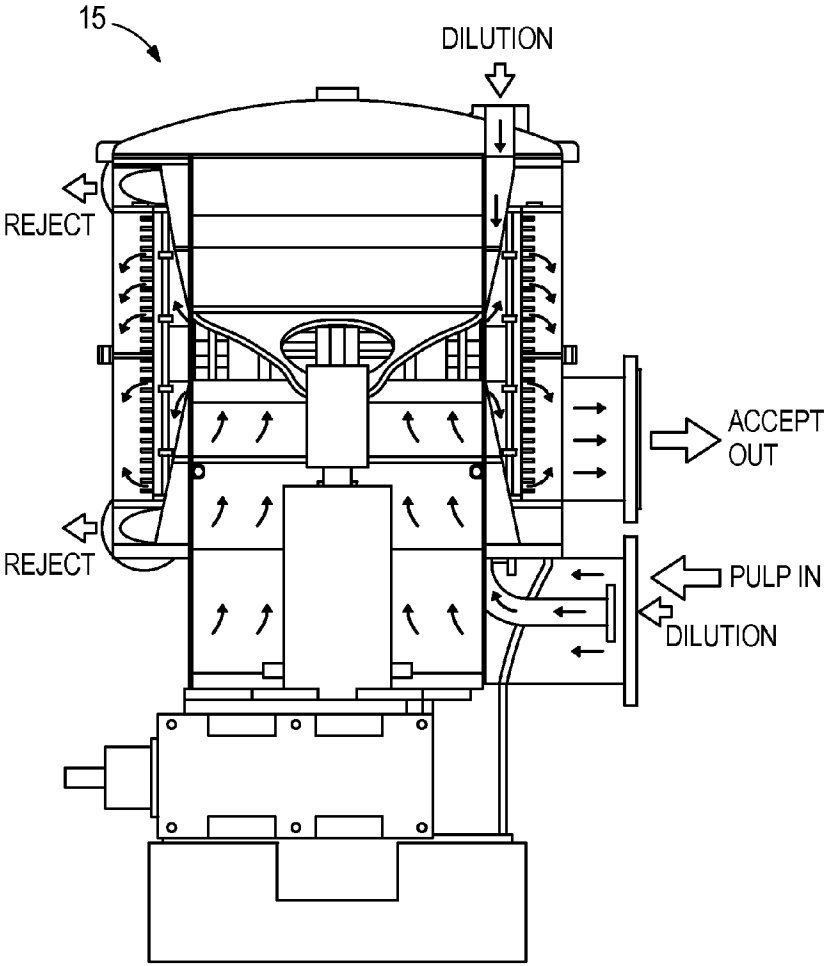
FIG. 5 PRIOR ART
FIG. 5 is a schematic side view of another conventional rotor where a pulp suspension enters the space between the rotor surface and the screen about midway down the screen, with half of the pulp suspension traveling up, and half down, the rotor.
Figure 4:
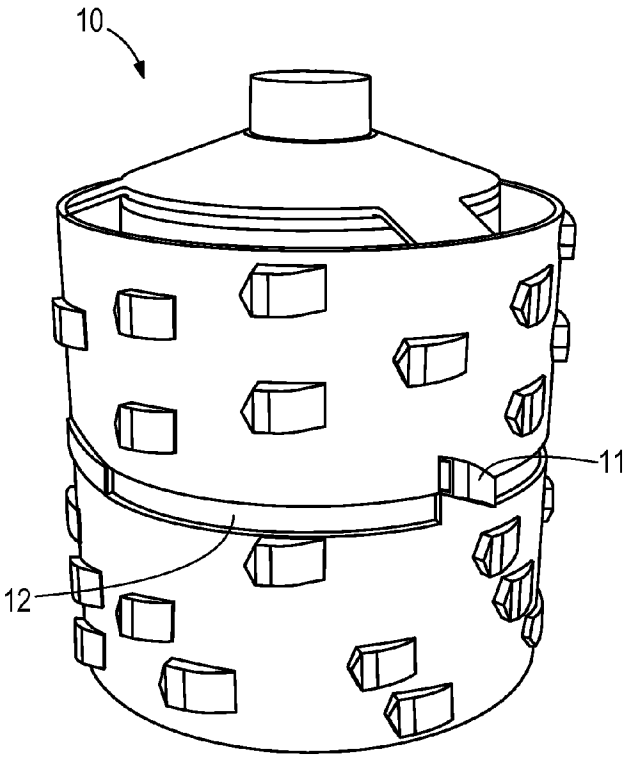
FIG. 4 PRIOR ART
FIG. 4 is a perspective side view of a conventional rotor where about half of a pulp suspension enters over the top of the rotor and about half passes through the rotor to a slot about half way down the rotor.

FIGS. 2 and 3 schematically illustrate one embodiment of pulse generating projections as well as a representation of their zone of interaction with a screen. FIG. 2 shows a rotor 121 whose surface 130 has been unrolled to show the plan view appearance of the projections, or half-foils (so termed, since only the radially outer half of the foil stands above the rotor surface), as they would be seen prior to rolling. Half-foils 123 have a uniform spiral angle 33 relative to the axis of the rotor. This spiral angle may be between approximately twenty-five and sixty-five degrees to the rotor axis but is preferably between forty and fifty degrees. Accelerating vanes 125 extend as continuations of the leading edges of foils 123 along the portion of the rotor within pulp entrance zone 97. Note that the projections have straight leading edges as seen on the unrolled rotor surface. Because of the inclination of the leading edges, the projections have a downward pumping effect on the slurry. This maintains flow of the slurry through the screening chamber so that rejects are transported rapidly to the rejects chamber.

Rotor 121 is seen from above in FIG. 3. Screen 95 has apertures 99 through which accepted fiber along with pulp liquor has a normal outflow 220. Because of the rotation of rotor 121, half-foil 123 has a relative velocity 218, with respect to the pulp being treated, lower than its absolute velocity. This is due to the tangential velocity of the pulp within the screening chamber as a result of the stirring action of the half-foil members 123 on the pulp. The relative velocity 218 generates a pressure excursion at the screen plate due to a venturi-like effect between foil 123 and screen 95. It begins with a rapid pressure increase immediately prior to the passage of the leading edge of the foil. This is immediately followed by a precipitous pressure drop that gradually tapers back to the equilibrium positive pressure for the screening chamber. This results in a peak negative pressure occurring near the zone of closest proximity between foil 123 and screen plate 95. When superimposed on the constant positive pressure attributable to feed pressure plus height of the slurry above that point on the screen and to the centrifugal force of the circumferential flow of the pulp slurry, the result is a flow reversal that converts outflow 220 into backflow 222. This tends to flush coarse fiber bundles and other particles from the apertures of the screen 95 and to break-up screen blinding caused by entangled fibers. In addition, it also returns pulp liquor having a reduced fiber content to the screening chamber and thereby prevents thickening. This maintains screening efficiency without the need for the addition of dilution liquid.

In accordance with this disclosure, an improvement to the rotor of FIGS. 1, 2 and 3 is shown in FIGS. 6 through 11, where like elements have the same numbering. A rotor 300 is formed with a generally cylindrical shell 304, and is hollow and has an interior 308, and an exterior 312 with pressure impulse protuberances 123 thereon for rotation with the rotor in close proximity to the inlet surface of the screen 95. The pulp or stock inlet 98 of the apparatus of FIG. 1 communicates with a screening space 93 defined between the rotor outer surface 312 and the inlet side of the screen 95. The stock inlet 98 also communicates with the rotor interior 308, with approximately half of the pulp suspension or slurry flowing from the inlet chamber 96 into the rotor interior 308, and the other half flowing from the inlet chamber 96 around the rotor 300 and into the screening space 93.

Figure 6:
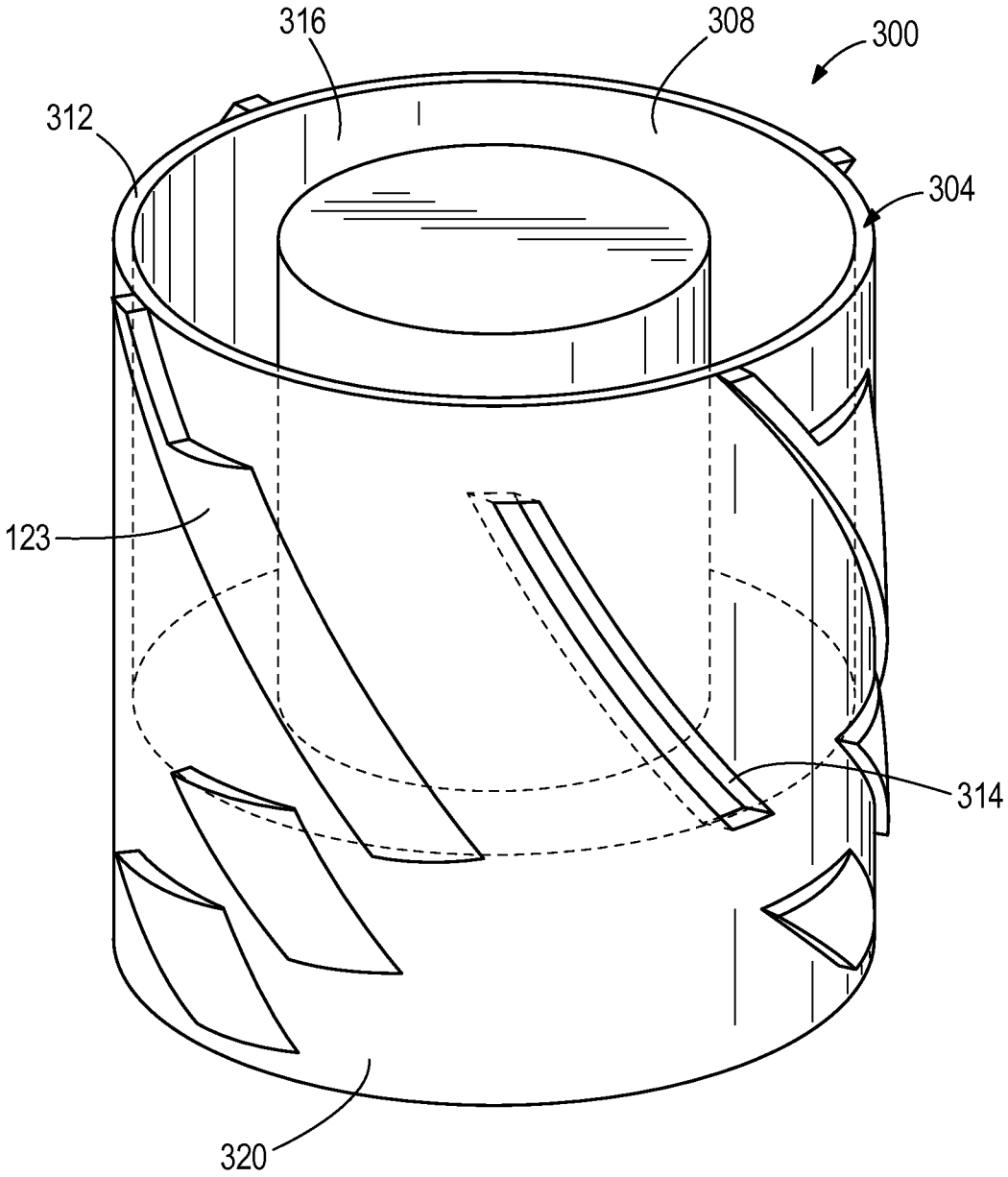
FIG. 6 is a schematic perspective view of a rotor according to this disclosure.
Figure 7:
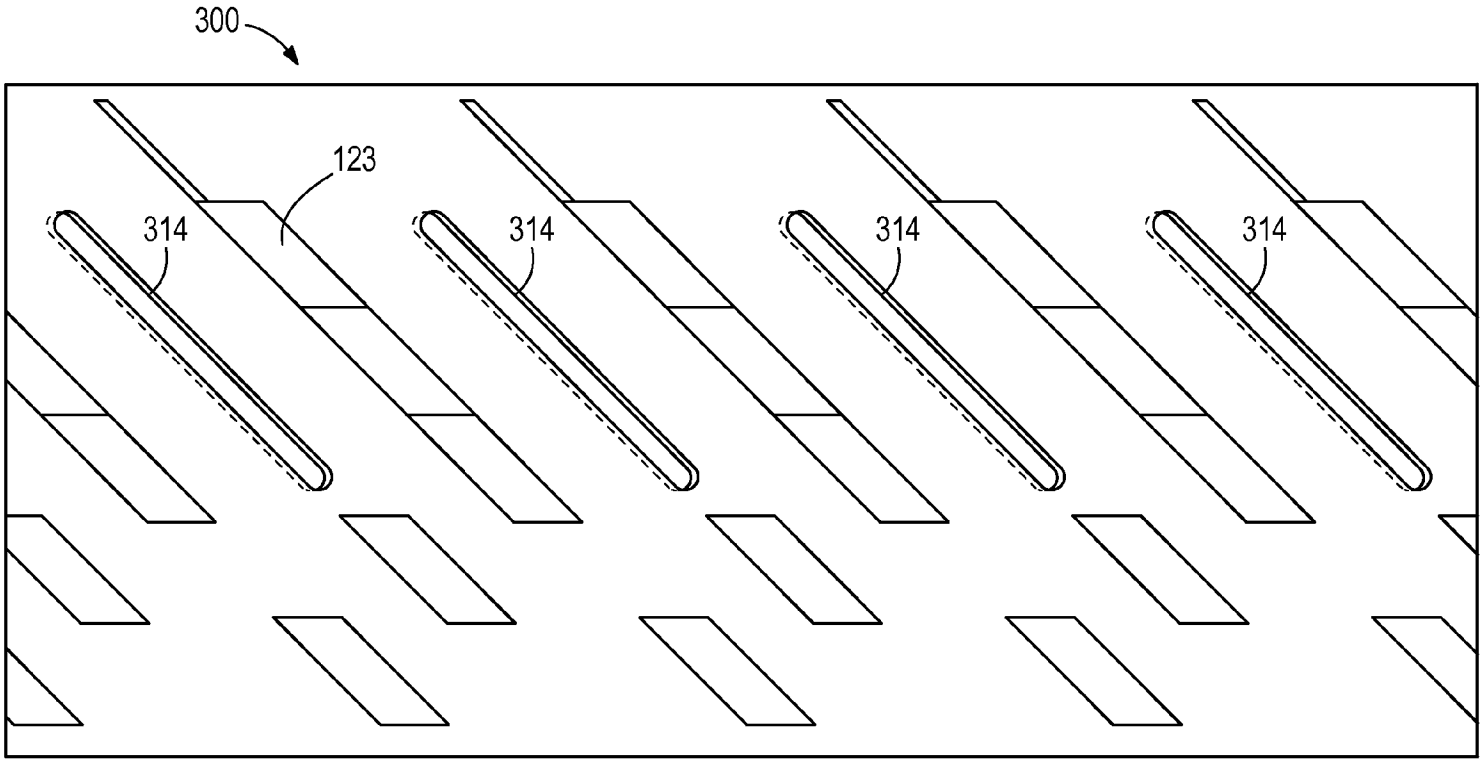
FIG. 7 is a view similar to FIG. 2, but with the openings of this disclosure added to the rotor shell.
Figure 8:
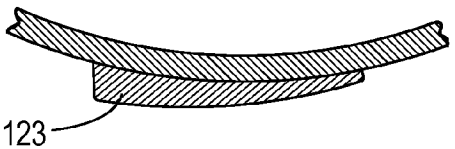
FIG. 8 is a side view of the protuberances on the rotor shell.
Figure 9:
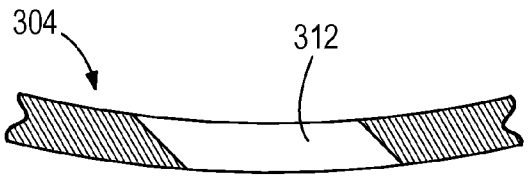
FIG. 9 is a cross section through the wall of the rotor showing an opening or slot in the rotor shell.

The rotor 300 also has at least one opening 314 extending in the screening flow direction from the rotor's interior 308 to the rotor's exterior 312 for over at least a fourth of screening flow length of the rotor 300. In the illustrated embodiment, the screening flow length is from the top of the rotor to the bottom of the rotor, as shown in FIG. 6, the pulp suspension flowing in a vertical direction from the top 316 of the rotor 300 to the bottom 320. As shown in FIG. 7, in the illustrated embodiment, there are 4 such openings 314 spaced apart around the circumference of the rotor 300. As shown in FIG. 9, each opening 314 is angled relative to a radial line from the center of the rotor 300. These openings pass a substantial portion (ideally half of the pulp suspension from the stock inlet) of pulp suspension from the stock inlet and the rotor interior into the screening space 93. In other less preferred embodiments (not shown), more or less slurry can pass through the openings.

In the illustrated embodiment, each opening 314 is continuous for over at least a fourth of screening flow length of the rotor 300. In other less preferred embodiments (not shown), the openings can be a number of linearly aligned spaced apart openings with a similar amount of open area, or in other embodiments, staggered or non-aligned openings.

As shown, each of the openings 314 is located between the foils 123 that form the protuberances for cleaning the screen 95. In other less preferred embodiments (not shown), more or less openings can be used.

Figure 10:
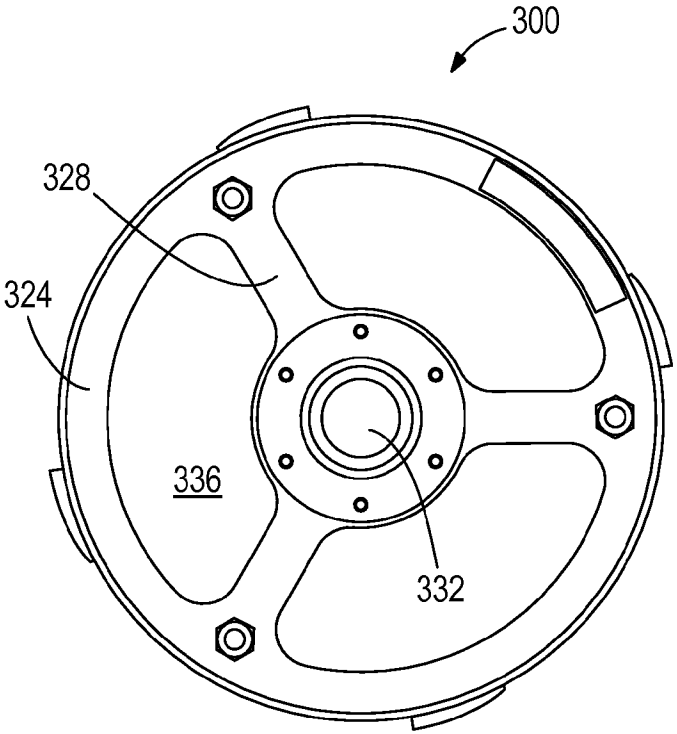
FIG. 10 is a top view of the rotor of FIG. 8.
Figure 11:
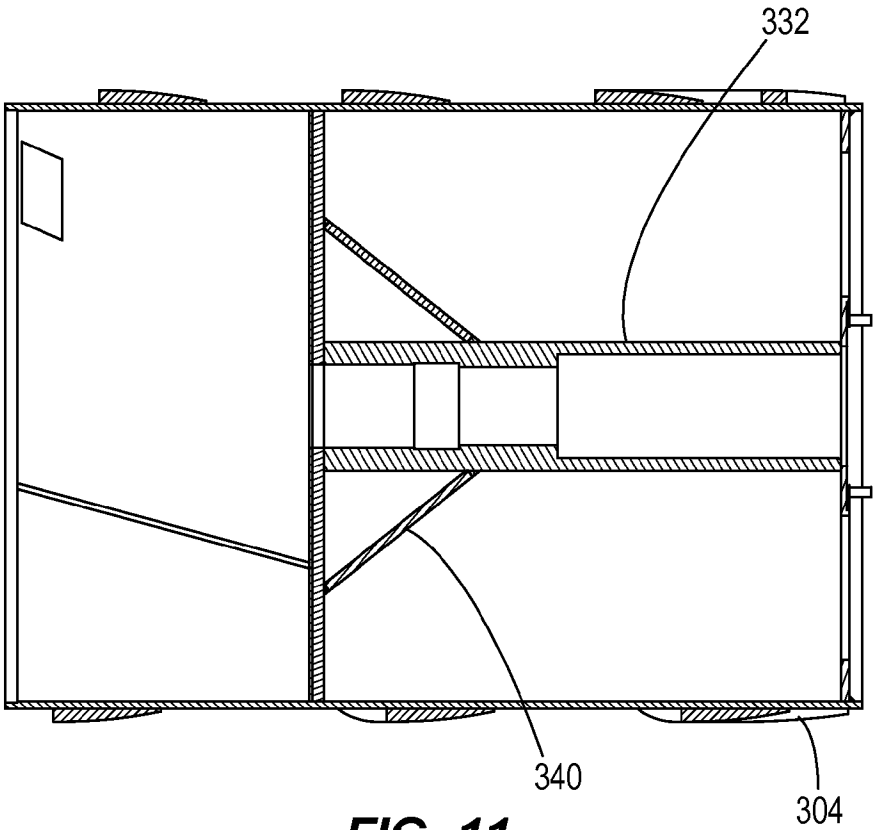
FIG. 11 is a cross sectional side view of the rotor of FIG. 8.

In the illustrated embodiment, as shown in FIG. 10, one end of the rotor includes a top plate 324 with at least two radial brackets or arms 328; three narrow webs in this embodiment, extending between a rotor central column 332 and the rotor shell 304. The space between the arms 328 defines an inlet 336 into the rotor interior 308, in communication with the at least one opening 314. This is to stabilize the top 316 of the rotor. The rotor interior 308 also includes a bracket or cone 340 (see FIG. 11) connected to the rotor shell 304 that supports the central column 332. This is for adding stiffness to the rotor. A rotor (not shown) can also be made without either of these features if the structure is strong enough.

In the illustrated embodiment, the opening 314 is angled about 45 degrees relative to the screening flow direction. This places it in parallel to the surface foils 123, and helps to minimize the amount of rotation imparted to the slurry passing through the opening 314. The opening 314 also begins down about one fourth of screening flow length of the rotor along the rotor 300 in the screening flow direction, and ends just past half way of screening flow length of the rotor along the rotor 300 in the screening flow direction. This insures the slurry passing through the opening 314 is still allowed a significant opportunity to be presented to the screen 95 in order to separate pulp accepts from pulp rejects.

In operation, the problem to be overcome is that the entry velocity into the annular space 93 between the drum-style rotor 300 and the screen 95 gets extremely high as screens become larger (the screen plate area goes up as the square of diameter, but the opening area goes up linearly). The open top 316 of the illustrated rotor communicates via the opening 314 or slot in the rotor surface to admit more stock down the length of the rotor 300, so that it doesn't have to all come in through the top of the apparatus. Everything at all times moves downward (in a top-fed vertical screen; it would go horizontally in a horizontal screen or upward in a bottom-fed screen). The relative opening sizes are such that a big part of the flow still comes in the top 316 as it always did; but the remainder of the flow comes out through the drum surface 312 to join the downward flow over the length of the rotor 300.

This opening modification is applicable to nearly any rotor design. The openings 314 are placed circumferentially in such a way that they do not interfere with the upstream foil, or pulse generator, but within that constraint as close to it as possible so as to maximize the screen plate exposure before the next foil passes.

The openings are also angled in cross-section (refer to the lower cross-section in FIG. 9) in such a way as to minimize the rotational energy transferred from the rotor 300 to the fluid. In other words, we want as much "slip" as possible.

The area of the openings 314 is further carefully calculated so that the flow resistance provided is sufficient to make sure that even at reduced flow, there will be a downward flow at all points down the length of the rotor 300. In other words, we do not want flow to simply bypass to the openings, with none going into the normal stock entry annulus.

Various other features of this disclosure are set forth in the following claims.

The invention claimed is:

1. A rotor for a pressure screening apparatus for screening a pulp suspension, the apparatus including a housing, a screen in the housing having an inlet surface and an outlet surface, a stock inlet in the housing, a stock outlet in the housing for receiving screened fibers passing through the screen, and a rejects outlet in the housing for receiving reject material from the inlet surface of the screen, the rotor being adapted for mounting for rotation within the screen, and for defining an annular screening space between the rotor and the screen so that the pulp suspension flows into the screening space, with accepted pulp passing through the screen to the stock outlet and rejected pulp passing along the screen inlet surface in a screening flow direction to the rejects outlet, the rotor having an interior, and an exterior with pressure impulse protuberances thereon for rotation with the rotor in close proximity to the inlet surface, the stock inlet communicating with the screening space and the rotor interior, so that the stock inlet directs the pulp suspension to one end of the rotor, where it enters the screening space and the interior of the rotor, the rotor further having at least one opening extending in the screening flow direction from its interior to its exterior for over at least a fourth of screening flow length of the rotor for admitting a substantial portion of pulp suspension from the stock inlet and the rotor interior into the screening space.

2. A rotor according to claim 1 in which the rotor is formed with a generally cylindrical shell.

3. A rotor according to claim 2 wherein there is a plurality of the openings spaced apart around the circumference of the cylindrical rotor.

4. A rotor according to claim 1 wherein the opening is continuous for over at least a fourth of screening flow length of the rotor.

5. A rotor according to claim 1 wherein the rotor is hollow for over at least a fourth of screening flow length of the rotor.

6. A rotor according to claim 1 wherein the one end of the rotor includes at least two radial arms extending between a rotor central column and a rotor shell, the space between the brackets defining an inlet into the interior of the rotor, in communication with the at least one opening.

7. A rotor according to claim 1 wherein the rotor interior includes a bracket supporting the central column.

8. A rotor according to claim 1 wherein the opening is angled relative to the screening flow direction.

9. A rotor according to claim 1 wherein the opening begins about one fourth of screening flow length of the rotor along the rotor in the screening flow direction, and ends just past half way of screening flow length of the rotor along the rotor in the screening flow direction.

10. A rotor according to claim 1 wherein the opening is angled relative to a radial line from the center of the rotor.

11. A pressure screening apparatus for screening a pulp suspension, the apparatus including a housing, a screen in the housing having an inlet surface and an outlet surface, a stock inlet in the housing, a stock outlet in the housing for receiving screened fibers passing through the screen, a rejects outlet in the housing for receiving reject material from the inlet surface of the screen, and a rotor mounted for rotation within the screen, and defining a screening space between the rotor and the screen so that the pulp suspension flows into the screening space, with accepted pulp passing through the screen to the stock outlet and rejected pulp passing along the screen inlet surface in a screening flow direction to the rejects outlet, the rotor having an interior, and an exterior with pressure impulse protuberances thereon for rotation with the rotor in close proximity to the inlet surface, the stock inlet communicating with the screening space and the rotor interior, so that the stock inlet directs the pulp suspension to one end of the rotor, where it enters the screening space and the interior of the rotor, the rotor further having at least one opening extending in the screening flow direction from its interior to its exterior for over at least a fourth of screening flow length of the rotor for admitting a substantial portion of pulp suspension from the stock inlet and the rotor interior into the screening space.

12. A pressure screening apparatus according to claim 11 in which the rotor is formed with a generally cylindrical shell.

13. A pressure screening apparatus according to claim 11 wherein there is a plurality of the openings spaced apart around the circumference of the cylindrical rotor.

14. A pressure screening apparatus according to claim 11 wherein the opening is continuous for over at least a fourth of screening flow length of the rotor.

15. A pressure screening apparatus according to claim 11 wherein the rotor is hollow for over at least a fourth of screening flow length of the rotor.

16. A pressure screening apparatus according to claim 11 wherein the opening is angled relative to the screening flow direction.

17. A pressure screening apparatus according to claim 11 wherein the opening begins about one fourth of screening flow length of the rotor along the rotor in the screening flow direction, and ends just past half way of screening flow length of the rotor along the rotor in the screening flow direction.

18. A rotor according to claim 11 wherein the opening is angled relative to a radial line from the center of the rotor.

* * * * *